US008540829B2

(12) United States Patent
Thomas et al.

(10) Patent No.: US 8,540,829 B2
(45) **Date of Patent: *Sep. 24, 2013**

(54) ELECTRICALLY INITIATED DEVICE AND SYSTEM INCORPORATING SAME

(75) Inventors: Toby D. Thomas, Southlake, TX (US); James Horning, Fort Worth, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/563,042

(22) Filed: Jul. 31, 2012

(65) Prior Publication Data

US 2012/0295128 A1 Nov. 22, 2012

Related U.S. Application Data

(62) Division of application No. 12/507,064, filed on Jul. 22, 2009, now Pat. No. 8,241,443.

(60) Provisional application No. 61/085,011, filed on Jul. 31, 2008.

(51) Int. Cl.

| | |
|---|---|
| ***C06B 45/00*** | (2006.01) |
| ***C06B 45/12*** | (2006.01) |
| ***C06B 45/14*** | (2006.01) |
| ***C06B 33/00*** | (2006.01) |
| ***D03D 23/00*** | (2006.01) |
| ***D03D 43/00*** | (2006.01) |

(52) U.S. Cl.
USPC ..... 149/109.2; 149/2; 149/14; 149/15; 149/37; 149/109.4

(58) Field of Classification Search
USPC ..... 149/109.4, 2, 14, 15, 37, 109.2
See application file for complete search history.

(56) References Cited

U.S. PATENT DOCUMENTS

| | | | | |
|---|---|---|---|---|
| 3,407,604 | A * | 10/1968 | Keith et al. | 60/217 |
| 5,464,699 | A * | 11/1995 | Baldi | 428/607 |
| 5,518,807 | A * | 5/1996 | Chan et al. | 428/305.5 |
| 7,722,782 | B2 * | 5/2010 | Coffey et al. | 252/70 |
| 8,241,443 | B1 * | 8/2012 | Thomas et al. | 149/2 |
| 2011/0198913 | A1 * | 8/2011 | Thornqvist et al. | 299/16 |

* cited by examiner

*Primary Examiner* — James McDonough
(74) *Attorney, Agent, or Firm* — Slater & Matsil, L.L.P.

(57) ABSTRACT

An electrically initiated security device includes a first energetic sheet, a second energetic sheet, and a corrugated energetic sheet disposed between the first energetic sheet and the second energetic sheet. A first surface of the corrugated energetic sheet defines at least one channel and a second surface of the corrugated energetic sheet defines at least one channel. The electrically initiated security device further includes a first constituent portion disposed in the at least one channel defined by the first surface and a second constituent portion disposed in the at least one channel defined by the second surface. The first constituent portion and the second constituent portion, when mixed, comprise an energetic material.

20 Claims, 3 Drawing Sheets

ELECTRICALLY INITIATED DEVICE AND SYSTEM INCORPORATING SAME

This is a divisional application of U.S. patent application Ser. No. 12/507,064, which was filed on Jul. 22, 2009 which claims the benefit of U.S. Provisional Application Ser. No. 61/085,011, filed Jul. 31, 2008, which are hereby expressly incorporated by reference for all purposes.

TECHNICAL FIELD

The present invention relates to devices used to disable equipment in the event of tampering or the like.

BACKGROUND

Situations may occur wherein equipment falls into the hands of non-friendly personnel or organizations. For example, military equipment may be captured or recovered by enemy forces or a business competitor may obtain equipment with the purpose of industrial espionage. In such situations, it is often desirable to disable or destroy the equipment, so that certain information cannot be determined by the non-friendly personnel or organization.

Devices have been developed to address problems such as these. While there are many designs of such devices well known in the art, considerable shortcomings remain.

SUMMARY OF THE INVENTION

In one aspect, embodiments of the present invention provide for an electrically initiated security system. The system includes a first energetic sheet, a second energetic sheet, and a corrugated energetic sheet disposed between the first energetic sheet and the second energetic sheet. A first surface of the corrugated energetic sheet defines at least one channel and a second surface of the corrugated energetic sheet defines at least one channel defined by the first surface. A first constituent portion is disposed in the at least one channel and a second constituent portion is disposed in the at least one channel defined by the second surface. The system further includes an igniter operably associated with at least one of the first energetic sheet, the second energetic sheet, and the corrugated sheet. The first constituent portion and the second constituent portion, when mixed, comprise an energetic material.

In another aspect, embodiments of the present invention provide for an electrically initiated security system that comprises a first sheet, a second sheet, and a third sheep between the first sheet and the second sheet. At least one of the first sheet, the second sheet, and the third sheet is configured to define a first cavity between the first sheet and the third sheet and a second cavity between the second sheet and the third sheet. A first material is contained within the first cavity, and a second material is contained within the second cavity and segregated from the first material by the third sheet. The first material and second material are selected so as to form an energetic material when mixed together. The system further includes an igniter configured to ignite at least one of the first sheet, the second sheet, and third sheet.

In yet another aspect, embodiments of the present invention provide for an electrically initiated security system comprising a component, a sensor configured to sense a condition associated with the component, and an igniter. The system further includes an electrically initiated security device coupled to the igniter. The device includes a container placed in proximity to the component, and defining an opening. Contained within the opening is a first sheet associated with a second sheet and forming therebetween a first cavity and a first material within the first cavity. Also contained within the opening is a third sheet associated with the second sheet and forming therebetween a second cavity, and a second material within the second cavity, the second material selected to form an energetic material when mixed with the first material. The igniter is configured to ignite at least one of the first sheet, the second sheet, and the third sheet in response to the sensed condition.

BRIEF DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
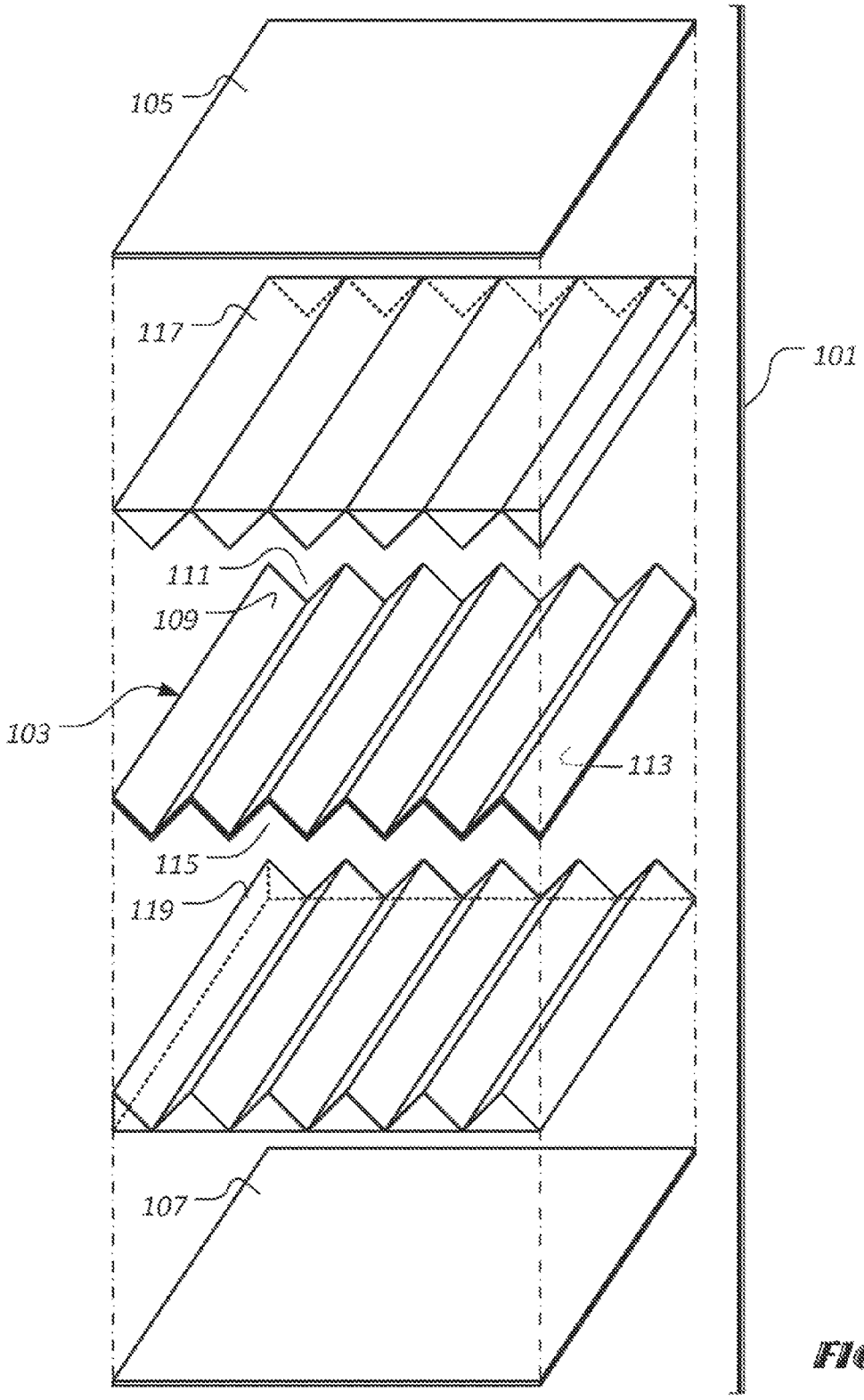
FIG. 1 is an exploded, perspective view of an illustrative embodiment of an electrically initiated security device.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an electrically initiated security device, a system employing the device, and a method of using the device. When activated, the device destroys, by burning, a component, such as an electrical or electronic component, disposed in close proximity to the burning direction of the device. The device is particularly useful in anti-tampering systems, wherein the device is activated upon unauthorized tampering with equipment in which the device is used. The device comprises a corrugated sheet of an energetic material, such as a metal, disposed between two non-corrugated layers of an energetic material, such as a metal. In one embodiment, the energetic material of at least one of the corrugated sheet and the non-corrugated sheets is magnesium foil. Powdered aluminum and powdered iron oxide, or other such materials, are disposed in separate channels defined by the corrugated energetic sheet. In one embodiment, the aluminum powder is disposed in channels defined by a first side of the corrugated sheet, while the iron oxide powder is disposed in channels defined by a second side of the corrugated sheet. Magnesium, aluminum powder, and iron oxide powder, as used in the device, are benign absent an electrical stimulus. The corrugated sheet, the non-corrugated layers, the aluminum powder, and the iron oxide powder are, in certain embodiments, disposed in a heat resistant cup, preferably made from a ceramic material. An igniter, such as an electrical ignition circuit, is operably associated with the energetic layers. Upon activation, the electrical ignition circuit excites the energetic layers, resulting in the aluminum and iron oxide powders being combined and ignited. The combined aluminum and iron oxide powders burn away from the open side of the cup, in embodiments that employ such a cup, which destroys one or more components in close proximity thereto. In embodiments that omit the cup, the combined aluminum and iron oxide powders burn to destroy one or more components proximate to the device. Materials other than aluminum powder and iron oxide powder are contemplated by the present invention.

FIG. 1 depicts an illustrative embodiment of an electrically initiated security device 101. Device 101 comprises a corrugated sheet 103 of magnesium foil disposed between two sheets 105 and 107 of magnesium foil. In the illustrated embodiment, sheets 105 and 107 are non-corrugated, although the present invention is not so limited. For the purposes of this disclosure, the term "foil" means a sheet exhibiting a thickness of less than about one millimeter. A first surface 109 of corrugated sheet 103 defines one or more channels 111 and second surface 113 of corrugated sheet 103 defines one or more channels 115. Disposed in channels 111 are portions 117 of a first constituent, e.g., aluminum powder. Disposed in channels 115 are portions 119 of a second constituent, e.g., iron oxide powder. Note that only one instance each of elements 111, 115, 117, and 119 is labeled in FIG. 1 for clarity. Portions 117 of aluminum powder are disposed between sheet 105 and corrugated sheet 103. Portions 119 of aluminum powder are disposed between sheet 107 and corrugated sheet 103.

Figure 2:
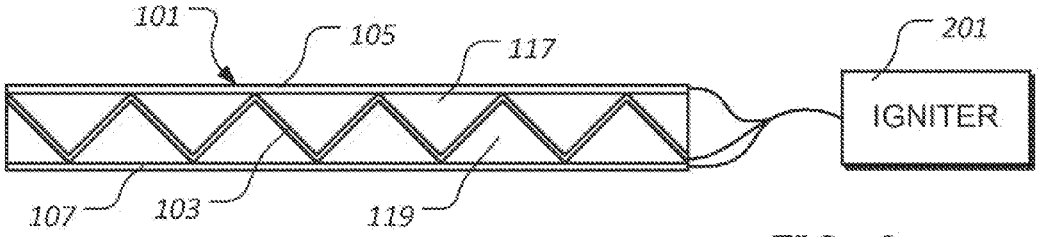
FIG. 2 is a side, elevational view of an illustrative embodiment of an electrically initiated security system employing the device of FIG. 1.

As shown in FIG. 2, an igniter 201 is operatively associated with device 101 to initiate one or more of corrugated sheet 103, sheet 105, and sheet 107. Upon initiation, the one or more of corrugated sheet 103, sheet 105, and sheet 107 ignite and burn, allowing portions 117 of aluminum powder and portions 119 of iron oxide powder to mix, forming an energetic material such as thermite or the like. The burning sheet or sheets, i.e., corrugated sheet 103, sheet 105, and/or sheet 107 ignite the mixed portions 117 and 119.

Figure 3:
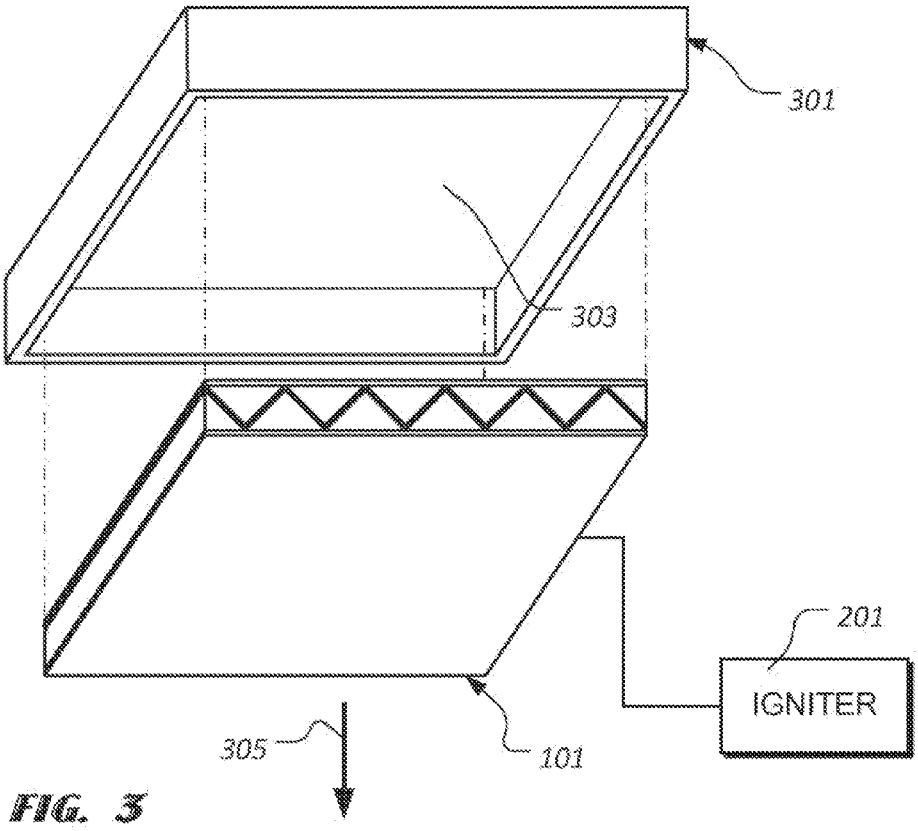
FIG. 3 is a partially exploded, perspective view depicting an illustrative embodiment of an electrically initiated security system employing the device of FIG. 1, alternative to that of FIG. 2.

In one embodiment, shown in FIG. 3, electrically initiated security device 101 is disposed in a fire-resistant cup 301 made from a material, such as, for example, ceramic or the like. Cup 301 defines a cavity 303 in which device 101 is received. In embodiments that include cup 301, the burning action of the ignited device 101 is directed by cup 301 via the open side of cup 301, e.g., in a direction corresponding to an arrow 305. In one embodiment, an electrically initiated security system comprises device 101 and igniter 201 operatively associated with device 101. In an alternative embodiment, an electrically initiated security system comprises device 101, igniter 201 operatively associated with device 101, and cup 301, in which device 101 is disposed.

Figure 4:
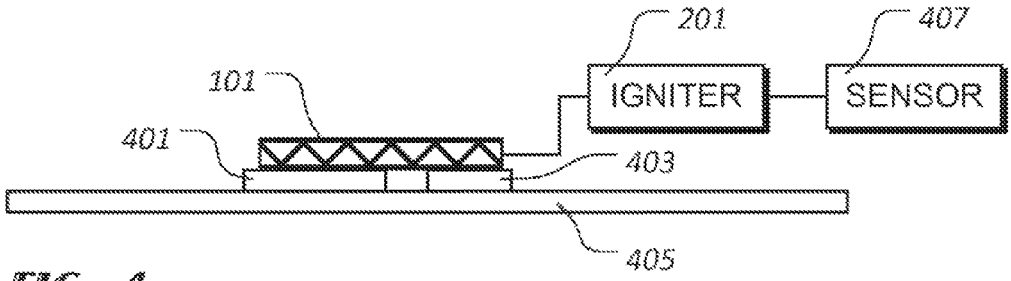
FIGS. 4 and 5 are side, elevational views depicting exemplary uses of the electrically initiated security device of FIG. 1.
Figure 5:
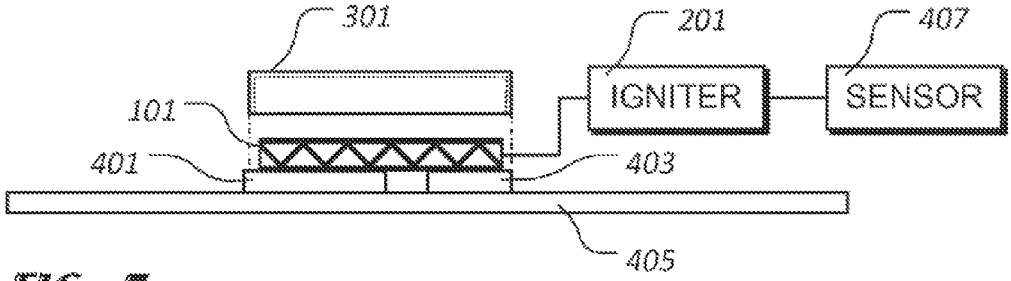

FIGS. 4 and 5 depict illustrative, exemplary uses for electrically initiated security device 101 and, thus an electrically initiated security system employing device 101. In FIG. 4, one or more electrical components 401 and 403 are operably associated with a printed circuit board 405. Electrically initiated security device 101 is disposed on or adjacent the one or more electrical components 401 and 403. Igniter 201 is operably associated with device 101, e.g., as discussed herein, to ignite device 101 and, in turn, disable and/or destroy electrical components 401 and 403. A sensor 407 may be operably associated with igniter 201 for triggering igniter 201. For the purposes of this disclosure, the term "sensor" means any component, device, system, or the like suitable for triggering igniter 201. Examples of sensor 407 include a hardwired switch, a switch that is remotely operable, a proximity sensor, a light sensor, a heat sensor, a motion sensor, a sensor that detects one or more electrical properties, and the like. The embodiment shown in FIG. 5 corresponds to that of FIG. 4 with the addition of fire resistant cup 301, e.g., as described herein.

While corrugated sheet 103, sheet 105, and sheet 107 are disclosed herein as comprising magnesium foil, the scope of the present invention is not so limited. Rather, one or more of corrugated sheet 103, sheet 105, and sheet 107 may comprise another energetic material or energetic metal. Moreover, while constituent portions 117 and 119 are described herein as comprising aluminum powder and iron oxide powder, respectively, the scope of the present invention is not so limited. For example, the iron oxide powder may be replaced or augmented with cupric oxide and/or silver oxide. It should also be noted that any of these constituents may be in the form of high purity or "ultrapure" materials, e.g., having a purity of greater than, for example, about 99 percent, greater than about 99.5 percent, greater than about 99.99 percent, or greater than about 99.995 percent; in the form of nanomaterials, e.g., nanopowder, nanoparticles, nanotubes, or the like; and/or encapsulated materials, e.g., powders, particles, tubes, or the like encapsulated in, for example, a resin, a glass, or the like. High purity or ultrapure constituents allow, in certain configurations, a smaller amount of constituent material to be used to achieve a result comparable to larger amount of less pure material. Alternatively, a higher intensity result can be achieved with a comparable amount of high purity or ultrapure constituents, as compared to lower purity materials. Encapsulated materials extend the shelf life of the constituents by retarding inadvertent and undesired contamination by or chemical reactions with elements such as oxygen and the like, present in the environment in which the constituents are disposed.

The present invention provides significant advantages including (1) the ability to disable and/or destroy a component by electrically-activating a security device; and (2) providing such a device in which the materials are benign in the form employed in the device before the device is activated.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An electrically initiated system, comprising:

a first energetic sheet;

a second energetic sheet;

a corrugated energetic sheet disposed between the first energetic sheet and the second energetic sheet, a first surface of the corrugated energetic sheet defining at least one channel and a second surface of the corrugated energetic sheet defining at least one channel;

a first constituent portion disposed in the at least one channel defined by the first surface; and a second constituent portion disposed in the at least one channel defined by the second surface; and an igniter operably associated with at least one of the first energetic sheet, the second energetic sheet, and the corrugated sheet;

wherein the first constituent portion and the second constituent portion, when mixed, comprise an energetic material.

2. The electrically initiated system of claim 1, wherein at least one of the first energetic sheet, the second energetic sheet, and the corrugated sheet comprises:

an energetic metal.

3. The electrically initiated system of claim 1, wherein at least one of the first energetic sheet, the second energetic sheet, and the corrugated sheet comprises:

magnesium foil.

4. The electrically initiated system of claim 1, wherein the first constituent portion comprises:

aluminum powder.

5. The electrically initiated system of claim 4, wherein the second constituent portion comprises:

one of iron oxide, cupric oxide, and silver oxide.

6. The electrically initiated system of claim 1, wherein the second constituent portion comprises:

one of iron oxide, cupric oxide, and silver oxide.

7. The electrically initiated system of claim 1, wherein at least one of the first constituent portion and the second constituent portion comprises:

a high purity material.

8. The electrically initiated system of claim 1, wherein at least one of the first constituent portion and the second constituent portion comprises:

a nanomaterial.

9. The electrically initiated system of claim 1, wherein at least one of the first constituent portion and the second constituent portion comprises:

an encapsulated material.

10. The electrically initiated system of claim 1, further comprising:

a sensor operably associated with the igniter.

11. The electrically initiated system of claim 1, wherein the device is operably associated with an electronic component for disabling or destroying the electronic component upon initiation of the device.

12. An electrically initiated system comprising:

a first sheet;

a second sheet;

a third sheet between the first sheet and the second sheet, at least one of the first sheet, the second sheet, and the third sheet being configured to define a first cavity between the first sheet and the third sheet and a second cavity between the second sheet and the third sheet;

a first material contained within the first cavity;

a second material contained within the second cavity and segregated from the first material by the third sheet, the first material and second material being selected to form an energetic material when mixed together; and an igniter configured to ignite at least one of the first sheet, the second sheet, and third sheet.

13. The electrically initiated system of claim 12 further comprising:

a sensor associated with the igniter and configured to trigger the igniter in response to a sensed condition.

14. The electrically initiated system of claim 12 wherein at least one of the first sheet, the second sheet, and the third sheet comprises a magnesium foil.

15. The electrically initiated system of claim 12 wherein the first material comprises essentially aluminum powder.

16. The electrically initiated system of claim 15 wherein the second material is selected from the group consisting essentially of iron oxide, cupric oxide, silver oxide, and combinations thereof.

17. The electrically initiated system of claim 12 further comprising:

a cup defining a third cavity in which the first sheet, second sheet, and third sheet are disposed.

18. An electrically initiated system comprising:

a component;

a sensor configured to sense a condition associated with the component;

an igniter; and an electrically initiated device coupled to the igniter and including:

a container placed in proximity to the component, and defining an opening in which is contained a first sheet associated with a second sheet and forming therebetween a first cavity;

a first material within the first cavity;

a third sheet associated with the second sheet and forming therebetween a second cavity;

a second material within the second cavity, the second material selected to form an energetic material when mixed with the first material;

wherein the igniter is configured to ignite at least one of the first sheet, the second sheet, and the third sheet in response to the sensed condition.

19. The electrically initiated system of claim 18 wherein the opening of the container directs a burning action of the electrically initiated security device toward the component.

20. The electrically initiated device of claim 18 wherein the first sheet, the second sheet, and the third sheet are all comprised of a same material.

* * * * *